US007452317B2

(12) United States Patent
Graham et al.

(10) Patent No.: US 7,452,317 B2
(45) **Date of Patent: *Nov. 18, 2008**

(54) AIR EVACUATION SYSTEMS AND METHODS FOR LINING A CONTAINER

(75) Inventors: Thomas D. Graham, Winter Garden, FL (US); John Thomas Yoder, IV, Wildwood, MO (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/681,048

(22) Filed: Mar. 1, 2007

(65) Prior Publication Data

US 2007/0161481 A1 Jul. 12, 2007

Related U.S. Application Data

(63) Continuation-in-part of application No. 11/133,124, filed on May 19, 2005, now Pat. No. 7,374,528.

(51) Int. Cl.
*B31B 7/78* (2006.01)

(52) U.S. Cl. ..... 493/101; 493/313

(58) Field of Classification Search ..... 493/93, 493/100, 101, 104, 192, 217, 313; 53/175, 53/170, 449

See application file for complete search history.

(56) References Cited

U.S. PATENT DOCUMENTS

| | | | | |
|---|---|---|---|---|
| 2,328,798 | A * | 9/1943 | Gardner | 156/160 |
| 2,736,065 | A * | 2/1956 | Wilcox | 156/160 |
| 4,052,931 | A | 10/1977 | Morse et al. | |
| 4,537,584 | A | 8/1985 | Everman et al. | |
| 5,028,197 | A | 7/1991 | Krein et al. | |
| 5,735,786 | A | 4/1998 | Krueger et al. | |
| 6,132,350 | A | 10/2000 | Krueger et al. | |
| 6,773,385 | B2 | 8/2004 | Johnson et al. | |

* cited by examiner

*Primary Examiner*—Paul R Durand
(74) *Attorney, Agent, or Firm*—Armstrong Teasdale LLP

(57) ABSTRACT

An air evacuation system is used for lining a container with a flexible liner. The air evacuation system includes a platform for supporting the container in a formed state, the container including the liner in an unseated position within the cavity. The platform includes a base and a floor extending substantially parallel and spaced apart from the base such that a first air gap is formed between said base and said floor. The floor includes at least one opening therethrough and at least one spacer tab extending therefrom. The vacuum assembly is coupled to the platform and includes a pump in airflow communication with at least one inlet positioned in said base, said vacuum assembly is configured to draw air from the cavity such that the liner is positioned substantially adjacent to the interior surface of the container in a seated position.

20 Claims, 8 Drawing Sheets

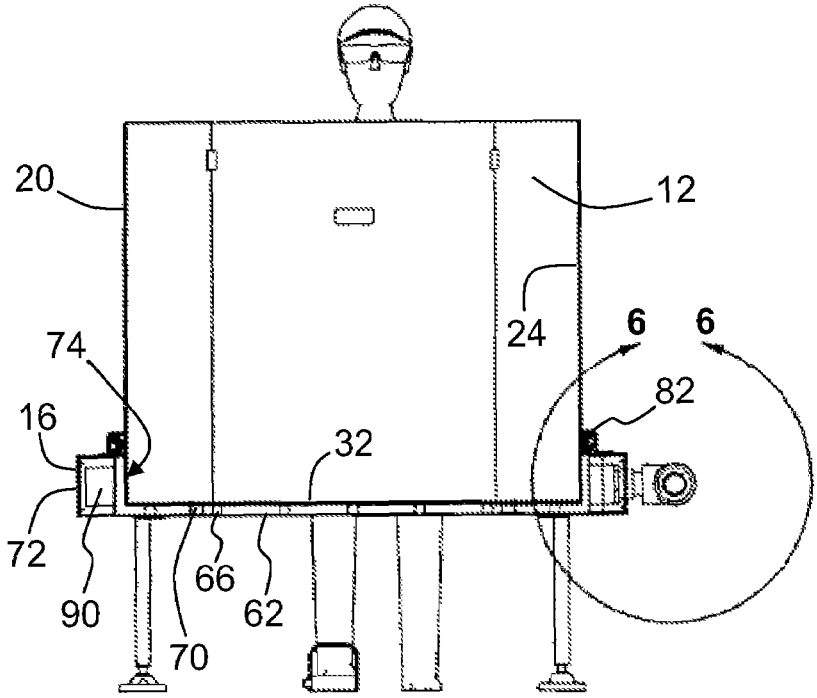
FIG. 5
FIG. 6
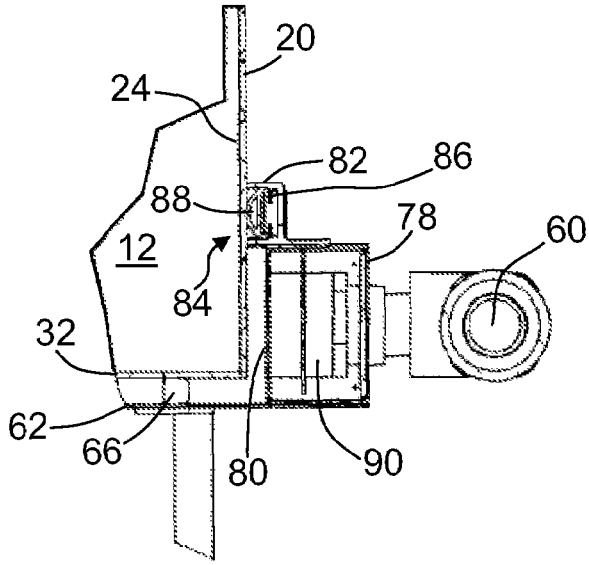

AIR EVACUATION SYSTEMS AND METHODS FOR LINING A CONTAINER

CROSS REFERENCE TO RELATED APPLICATIONS

This application is a continuation in part of and claims priority to U.S. patent application Ser. No. 11/133,124 now U.S. Pat. No. 7,374,528, and filed May 19, 2005, entitled "Air Evacuation Systems and Methods for Lining a Container," which is hereby incorporated by reference in its entirety.

BACKGROUND OF THE INVENTION

This invention relates generally to air evacuation systems and methods for lining a container, and more particularly, to air evacuation systems and methods for lining a container with a flexible liner.

Many businesses package products or waste materials before shipping the products or materials to other locations. Specifically, these businesses package the products or materials into containers for shipping and transportation. In at least some of these cases, the products or materials are packaged in containers lined with a flexible or plastic liner to reduce spoiling or spillage of the products or materials. For example, a corrugated container lined with a plastic liner may be used for shipping certain products or materials wherein the plastic liner is utilized to reduce spoilage of the products or leakage of the products through the corrugated container.

In at least some known applications of placing a flexible liner within a container, an operator will manually erect the container and then position the liner by hand within the container. This process can be time consuming and result in increased labor costs. Moreover, in at least some cases, the operator may fail to properly position the liner within the container (e.g., fully opening and expanding the liner within the container), which may result in reducing the amount of actual materials that can be loaded into the container or may result in damage to the liner when loading the materials into the container. In fact, in at least some know cases, an improperly positioned liner within a container may result in the liner being punctured during the loading of the material into the container, and thus, allowing the materials to spoil or leak through the container.

In response to the additional labor costs and improper positioning of a liner within a container, at least some known machines have been developed to aid in the lining of such containers. At least some known machines automate the lining process by physically placing the liner within the container. However, these machines require complex mechanical features and components. Specifically, mechanical arms are used to place the liner into the container along the sides and bottom walls of the container. At least some other known machines automate the lining process by placing the liner along the top of the container and blowing the liner into the container. At least some other known machines automate the lining process by removing the air between the liner and the container to draw the liner against the interior of the container. At least one of these known machines positions a vacuum plenum beneath an opened bottom portion of the container, and pulls the air from the container cavity through the open bottom portion of the container. However, because the container is formed after the liner is positioned within the container, the liner is not fully seated against the interior surfaces of the container.

BRIEF DESCRIPTION OF THE INVENTION

In one embodiment, an air evacuation system for lining a container with a flexible liner is provided. The container includes a plurality of walls defining a cavity with an open top wherein each wall has an interior surface and an exterior surface. The air evacuation system includes a platform for supporting the container in a formed state and the liner in an unseated position within the cavity. The platform includes a base and a floor extending substantially parallel and spaced apart from the base such that a first air gap is formed between the base and the floor. The floor includes at least one opening therethrough and at least one spacer tab extending therefrom for engaging a bottom wall of the container. The spacer tab elevates the bottom wall of the container from the floor creating a second air gap between the bottom wall of the container and the floor. The system also includes a vacuum assembly coupled to the platform that includes a pump in airflow communication with at least one inlet positioned in the base. The vacuum assembly is configured to draw air from the cavity through the bottom wall and the first and second air gaps and the at least one inlet such that the liner is positioned substantially adjacent to the interior surface of the container in a seated position.

In another embodiment, an air evacuation apparatus for positioning a flexible liner within a container is provided. The container includes a plurality of walls defining a cavity wherein each wall has an interior surface and an exterior surface. The air evacuation apparatus includes a platform including a base and a floor for supporting the container in a formed state and a plurality of side rails for aligning the container with respect to the platform wherein the container includes the liner in an unseated position within the cavity. The floor extends substantially parallel and spaced apart from the base such that a first air gap is formed between the base and the floor. The floor includes at least one opening therethrough and at least one spacer tab extending therefrom for engaging a bottom wall of the container wherein the spacer tab elevates the bottom wall of the container from the floor creating a second air gap between the bottom wall of the container and the floor. The apparatus includes a suction member coupled to at least one of the base and a side wall of the platform. The suction member is configured to position the unseated liner in a seated position adjacent the interior surface of the container by drawing air from the container cavity through the bottom wall such that substantially all of the air between the interior surface of the container and the unseated liner is removed.

In yet another embodiment, a method of lining a container with a flexible liner using an air evacuation system is provided. The container includes a plurality of walls defining a cavity with an open top wherein each wall has an interior surface and an exterior surface. The air evacuation system includes a platform for supporting the container including a base and a floor. The floor includes at least one opening and at least one spacer tab protruding therefrom. A vacuum assembly is coupled to an inlet in the base or a wall of the platform The method includes forming the container, positioning the container on the platform such that a bottom wall of the container is adjacent to the at least one spacer tab protruding from the floor, wherein the bottom of the container is elevated above the floor such that a first gap is defined therebetween. The method further includes positioning the liner at least partially within the container cavity, the liner being in an unseated position, and operating the vacuum assembly to create a vacuum around at least a portion of the container to draw air from the container cavity through the bottom wall, the first air gap, and the at least one opening such that the liner is positioned adjacent the interior surface of the container in a seated position.

BRIEF DESCRIPTION OF THE DRAWINGS

FIG. 5 is a cross sectional view of the air evacuation system taken along line 5-5 in FIG. 1 with the container positioned therein.

FIG. 6 is a cross sectional view of a portion of the air evacuation system and the container and taken along area 6-6 in FIG. 5.

DETAILED DESCRIPTION OF THE INVENTION

Figure 1:
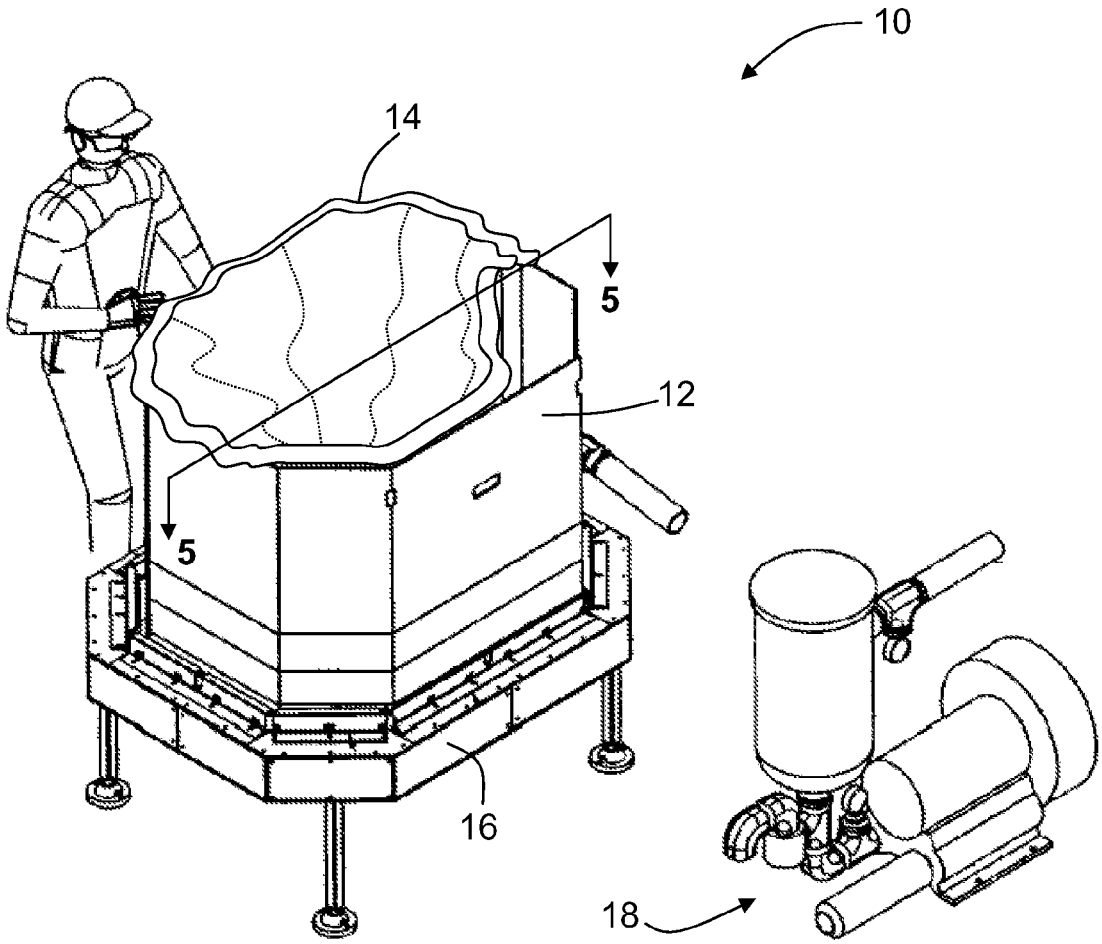
FIG. 1 is a perspective view of an air evacuation system for lining a container with a liner.

FIG. 1 is a perspective view of an air evacuation system 10 for lining a container or bin 12 with a flexible, bag-like liner 14. Air evacuation system 10 includes a platform 16 for supporting container 12, and a vacuum assembly 18. In an exemplary embodiment, vacuum assembly 18 is positioned adjacent to container 12 for removing excess air between liner 14 and container 12, thus eliminating the risk of liner 14 tears when loading a product into container 12. Additionally, vacuum assembly 18 facilitates automated lining of container 12 with liner 14 in a reduced time as compared to manual lining of container 12 with liner 14. Specifically, liner 14 is transferred from an unseated position, as illustrated in FIG. 1, to a fully seated position, substantially filling container 12, with the use of air evacuation system 10.

Figure 2:
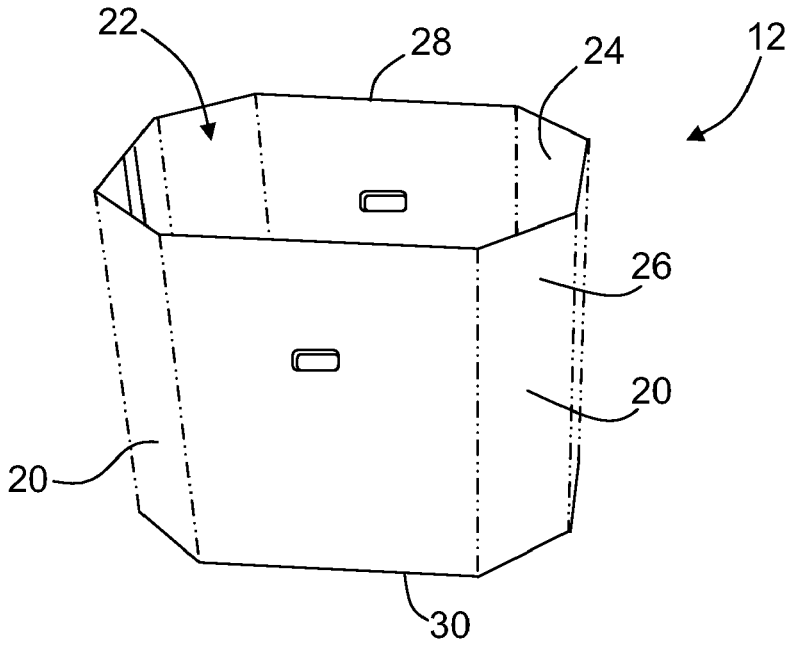
FIG. 2 is a top perspective view of the container shown in FIG. 1.
Figure 3:
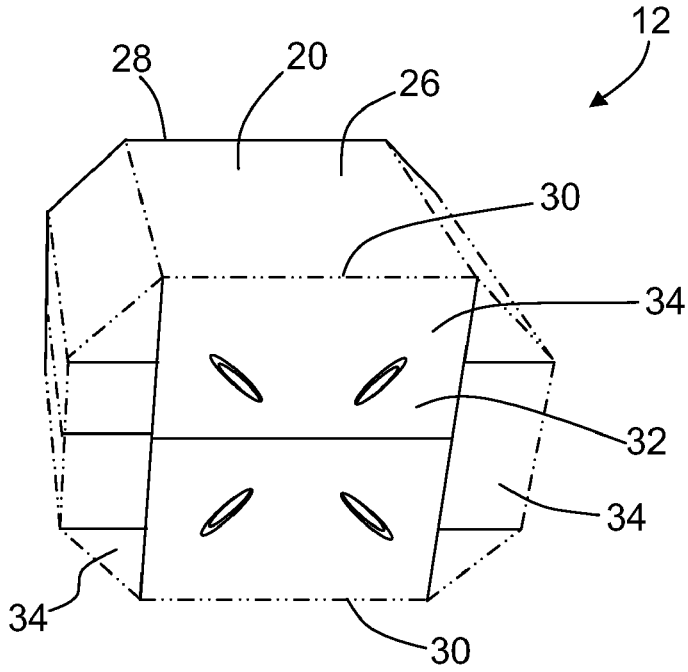
FIG. 3 is a bottom perspective view of the container shown in FIGS. 1 and 2.

FIGS. 2 and 3 are top and bottom perspective views, respectively, of container 12. Container 12 includes a plurality of walls or panels 20 defining a container cavity 22. In one embodiment, container walls 20 are fabricated from a porous or semi-porous material, such as a corrugated paperboard material, which allows air to flow therethrough. Walls 20 are connected to one another along fold lines and, during forming of container 12, at least two walls 20 overlap one another to form a seam. In an exemplary embodiment, container 12 includes eight walls 20 having an octagonal shape defining the sides of container 12. However, in alternative embodiments, container 12 includes more or less than eight side walls 20, and container 12 has another regular or irregular shape, such as, for example, square, rectangular, triangular, curvilinear, or the like.

Each wall 20 defining the sides of container 12 includes an inner surface 24 and an outer surface 26, and extends between a top edge 28 and a bottom edge 30. In an exemplary embodiment, container 12 is open to cavity 22 at top edge 28 and is closed to define cavity 22 at a bottom wall 32. As such, bottom wall 32 and walls 20 defining the sides of container 12 are collectively referred to as container walls. In one embodiment, bottom wall 32 is defined by a plurality of flaps 34. Each flap 34 is connected to a respective bottom edge 30 of each wall 20 at a fold line. During forming, flaps 34 are secured or coupled together using a mechanical feature, such as a retaining slot, or a chemical bond, such as an adhesive. Once assembled and formed, container 12 receives liner 14 (shown in FIG. 1), liner 14 is transferred from an unseated position to a seated position within container 12, and container 12 is filled with a product. In one embodiment, container 12 defines a bulk bin for housing waste material, such as waste material from a meat packaging plant. However, the use of container 12 is in no way limited to housing waste material. Once container 12 is filled with the product, a cover or lid (not shown) may be secured or otherwise placed over the open top of container 12, thus encasing the contents within container 12.

Figure 4:
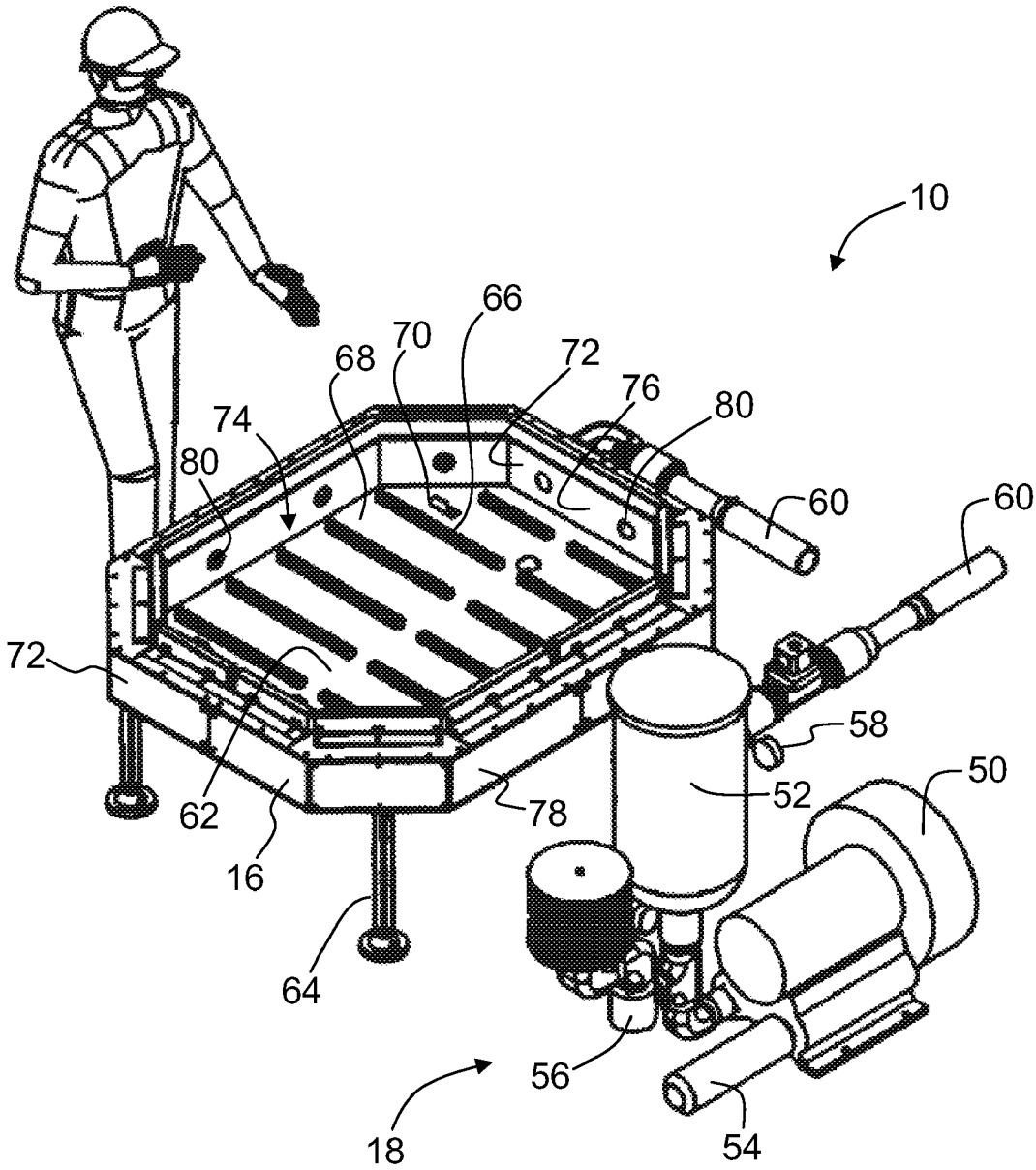
FIG. 4 is a top perspective view of the air evacuation system shown in FIG. 1 with the container removed for clarity.

FIG. 4 is a top perspective view of air evacuation system 10 with container 12 (shown in FIGS. 1-3) removed for clarity. Air evacuation system 10 includes vacuum assembly 18. In an exemplary embodiment, vacuum assembly 18 is a mechanical device that facilitates creating a suction or vacuum for drawing air through air evacuation system 10. In one embodiment, vacuum assembly 18 includes a pump or a blower 50 having a motor (not shown) for creating the vacuum. Vacuum assembly 18 also includes a filter 52 and a muffler 54. In one embodiment, vacuum assembly 18 includes a release valve 56 and a pressure gauge 58. Additionally, vacuum assembly 18 includes a plurality of tubes or hoses 60 coupled between pump 50 and platform 16.

Platform 16 includes a base 62 supported by a plurality of support legs 64. In an exemplary embodiment, base 62 is substantially planar and has a similar shape as container 12 (shown in FIG. 1). Base 62 is used to support container 12 when container 12 is positioned within or on platform 16. Base 62 includes a plurality of protrusions or ribs 66 raised from an upper surface 68 of base 62. As explained below in detail, ribs 66 provide an air gap or void between container bottom wall 32 and base 62. As such, a vacuum may be created between container 12 and base 62. Moreover, ribs 66 facilitate retaining container 12 in a formed state. Additionally, base 62 includes spacer tabs 70 extending from upper surface 68. Spacer tabs 70 protrude further than ribs 66 and engage container bottom wall 32 when positioned on base 62. Specifically, each spacer tabs 70 engages at least one flap 34 (shown in FIG. 3) of container 12 and displaces the respective flap 34 generally toward container cavity 22. As such, spacer tabs 70 facilitate creating an air gap or void between adjacent flaps 34 thus increasing an amount of air evacuated form container cavity 22 in addition to air evacuated through container walls 20 and 32.

Platform 16 also includes a plurality of side rails 72 defining a recess 74 for receiving container 12 therein. When installed, container walls 20 are positioned adjacent platform side rails 72, and in an exemplary embodiment, engage at least a portion of platform side rails 72. As a result, container 12 is positioned or aligned within platform 16, and retained in place for the air evacuation process by vacuum assembly 18. In an exemplary embodiment, each side rail 72 has an interior and an exterior surface 76 and 78, respectively. Vacuum tube 60 is coupled to exterior surface 78 such that vacuum assembly 18 is in airflow communication with platform 16. Moreover, interior surfaces 76 of each side rail 72 include air inlets 80 in airflow communication with vacuum tube 60. Specifically, and as will be described in detail below, side rails 72 have an internal channel (not shown) which communicates with inlets 80 and tube 60. As such, during operation, air is drawn through inlets 80, internal channel, and vacuum tube 60 by vacuum assembly 18. Additionally, each air inlet 80 is in airflow communication with recess 74. As a result, air within recess 74 is evacuated by vacuum assembly 18.

FIG. 5 is a cross sectional view of air evacuation system 10 taken along line 5-5 in FIG. 1 with container 12 positioned within platform 16. FIG. 6 is a cross sectional view of a portion of air evacuation system 10 and container 12 and taken along area 6-6 in FIG. 5. In an exemplary embodiment, as illustrated in FIGS. 5 and 6, formed container 12 is arranged within platform 16. Specifically, bottom wall 32 of container 12 is seated upon base 62, and more particularly, ribs 66 and/or spacer tabs 70. Additionally, container walls 20 are positioned adjacent platform side rails 72, and in one embodiment, have a friction or snug fit with respect to side rails 72. In an exemplary embodiment, container walls 20 have a friction or snug fit with a seal member 82.

Seal member 82, an embodiment of which is illustrated in FIG. 6, includes an inflatable bladder assembly 84. Bladder assembly 84 includes a frame 86 for supporting an inflatable bladder 88. In one embodiment, air is supplied to bladder 88 by an external air supply (not shown), and is released by a release valve (not shown). As bladder 88 is inflated, bladder 88 engages container walls 20 forming a seal completely around container 12. As a result, the vacuum created by vacuum assembly 18 and applied to container 12 can be maintained within recess 74, and particularly, within the air gap or void between container walls 20 and base 62 and/or side rails 72 of platform 16. In an alternative embodiment, seal member 82 is moveable toward and away from container 12 such that, when container 12 is positioned within platform 16, seal member 82 is moved toward container 12 until a seal is formed around container 12, and seal member 82 is moved away from container 12 to allow container 12 to be removed from platform 16. For example, seal member 82 is on glides (not shown) such that seal member 82 is moveable.

As further illustrated in FIGS. 5 and 6, vacuum tube 60 is coupled to exterior surface 78 of side rails 72 such that vacuum assembly 18 is in airflow communication with internal channel 90. Internal channel 90 extends entirely around platform 16 and communicates with the plurality of inlets 80 extending through internal surface 76 of platform side rails 72. As such, during operation, air is drawn from recess 74 through inlets 80, internal channel 90, and vacuum tube 60 by vacuum assembly 18. Moreover, air is drawn through container 12 when container 12 is positioned within platform 16.

In an exemplary embodiment, when operated, vacuum assembly 18 draws or sucks air from container cavity 22, through container walls 20, into recess 74. More specifically, vacuum assembly 18 draws the excess air located between inner surface 24 of container and liner 14. Additionally, vacuum assembly 18 then draws or sucks the air from recess 74, into air inlets 80, through internal channel 90 and vacuum tube 60. The air is then exhausted by blower 50 (shown in FIG. 4). As a result, when substantially all of the air is drawn from container cavity 22, liner 14 is positioned adjacent inner surface 24 of container 12. More specifically, liner 14 is eventually firmly seated against walls 20 and bottom wall 32 of container 12. As a result, the entire volume of container cavity 22 is available for receiving a product therein. Additionally, the risk of tearing liner 14 is reduced as the liner is firmly seated against inner surface 24 of container 12. Moreover, liner 14 is positioned automatically and without the need of operator assistance.

Figure 7:
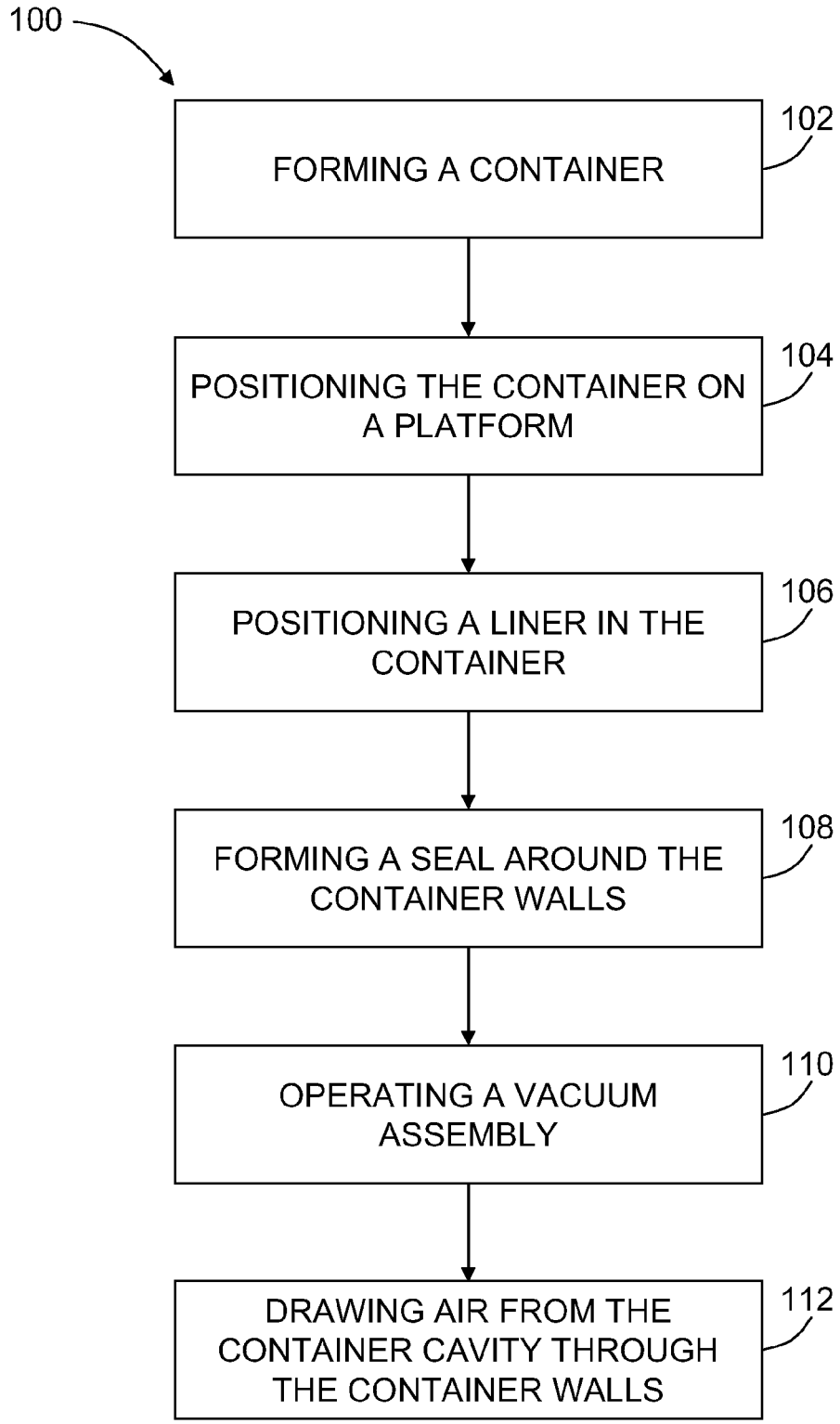
FIG. 7 is a flow chart identifying an exemplary method of using the air evacuation system shown in FIG. 1.

FIG. 7 is a flow chart identifying an exemplary method of lining 100 container 12 with flexible liner 14 using air evacuation system 10. In an exemplary embodiment, the method of lining 100 includes forming 102 container 12, and positioning 104 container 12 on platform 16. As indicated above, container 12 is formed from side walls 20 and bottom wall 32. Container 12 is erected into a predetermined shape, such as the octagonal shape illustrated in FIG. 1, having an open top.

Once formed, container 12 is positioned 104 on platform 16 such that bottom wall 32 engages base 62, and more particularly, engages ribs 66 and/or spacer tabs 70. As such, a gap or void is created between container bottom wall 32 and upper surface 68 of base 62. Moreover, container 12 is positioned 104 on platform 16 such that container side walls 20 are positioned adjacent platform side rails 72. In one embodiment, a gap or void is positioned between container and platform side rails 20 and 72.

Once container 12 is positioned, liner 14 is positioned 106 at least partially within container cavity 22. As such, liner 14 is initially positioned in an unseated position. In one embodiment, an operator positions liner 14 partially within container cavity 22 and extends or cuffs liner 14 around top edge 28 of container side walls 20. Additionally, the operator may secure liner 14 around top edge 28 using, for example, a securing strap or another mechanical feature which retains liner 14 at top edge 28. Alternatively, the operator may hold liner 14 at top edge 28 during use of air evacuation system 10.

In lieu of the operator manually placing liner 14 in a seated position wherein liner 14 is seated against inner surface 24 of container walls 20 and 32, the operator operates air evacuation system 10. For example, once liner 14 is positioned within container 12, the operator forms 108 a seal around outer surfaces 26 of container walls 20 using seal member 82. In one embodiment, air evacuation system 10 includes inflatable bladder assembly 84, and operator inflates bladder 88 such that a seal is formed around a perimeter of container 12. In one embodiment, the seal is positioned proximate to bottom wall 32 such that air evacuation system draws air through a bottom portion, particularly bottom wall 32 and portions of side walls 20 adjacent bottom wall 32, of container 12.

Once the seal is formed around container 12, the operator operates 110 vacuum assembly 18. In one embodiment, the operator operates 110 vacuum assembly 18 using a foot switch. When activated, vacuum assembly 18 creates a vacuum to draw air therethrough. In operation, vacuum assembly 18 includes a vacuum pump 50 that facilitates creating the vacuum, and a plurality of vacuum tubes 60 in flow communication with vacuum pump 18 and platform 16. As such, air is drawn from the gap or void between container 12 and platform 16, through inlets 80 and internal channel 90 and into vacuum tubes 60. In one embodiment, the amount of air drawn through the individual air inlets 80 is varied by vacuum assembly 18 such that a differential air pressure is created within the gap or void and against the various side walls 20 and bottom wall 32 of container 12. The differential air pressure facilitates controlling the positioning of liner 14 within container 12 by varying the suction force within container 12.

Moreover, vacuum assembly 18 also draws 112 air from container cavity 22 into the gap or void between container 12 and platform 16. In one embodiment, air is drawn 112 through container side walls 20 and bottom wall 32. As such, the air is evacuated from container cavity 22. As the air is evacuated from container cavity 22, liner 14 is drawn into container cavity 22 and is eventually seated against inner surfaces 24 of container side walls and bottom wall 32. Particularly, substantially all of the air between liner 14 and inner surfaces 24 of container side walls and bottom wall 32 is evacuated such that liner 14 is positioned adjacent inner surfaces 24. As a result, the entire volume of container cavity 22 is available for receiving the product therein. Additionally, the risk of tearing liner 14 is reduced as liner 14 is firmly seated against inner surface 24 of container 12. Moreover, as indicated by the various steps of method 100, liner 14 is positioned automatically and without the need of operator assistance.

Figure 8:
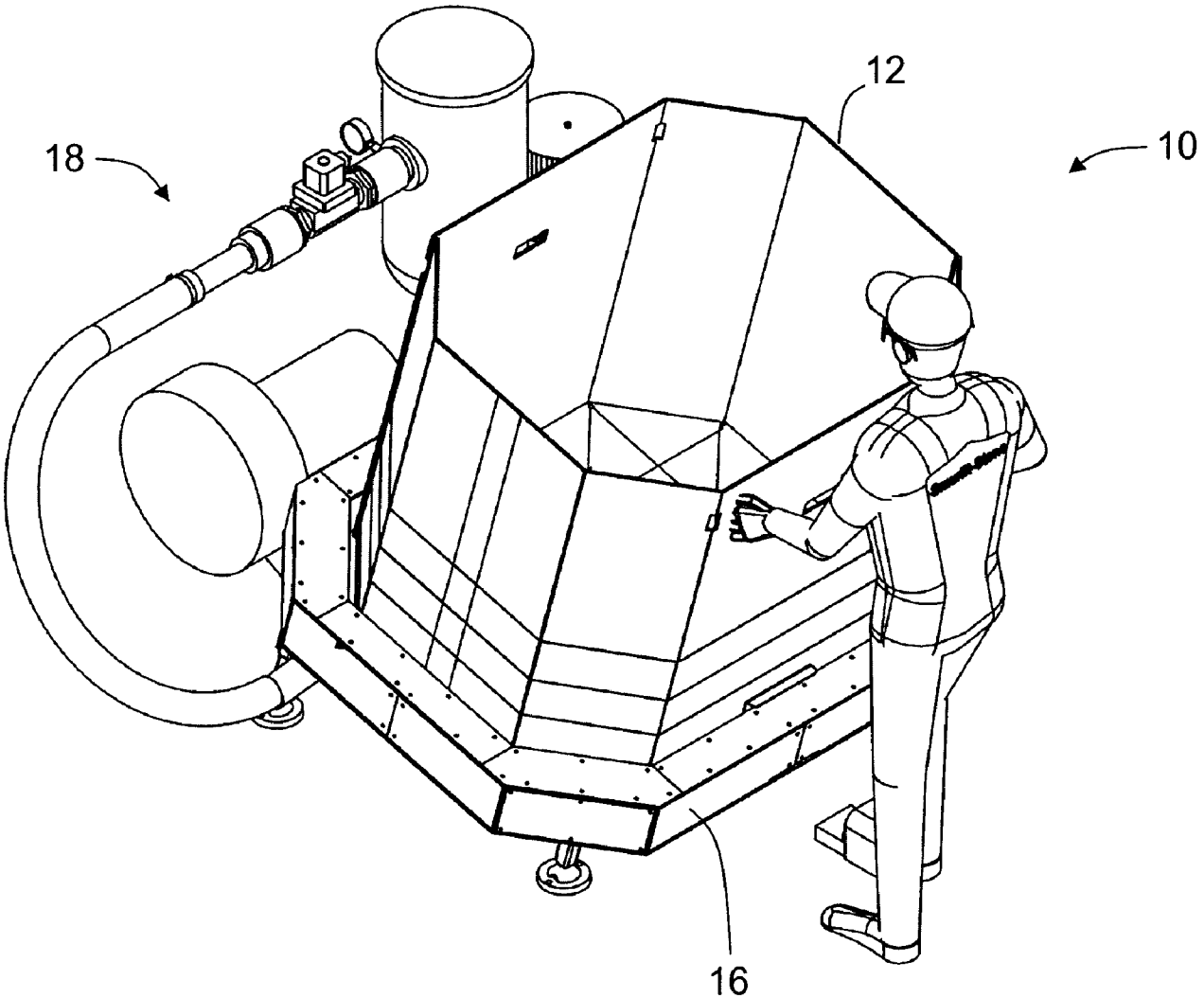
FIG. 8 is a perspective view of the air evacuation system in accordance with another embodiment of the present invention.

FIG. 8 is a perspective view of air evacuation system 10 in accordance with another embodiment of the present invention. In the exemplary embodiment, air evacuation system 10 is configured for lining a container or bin 12 with a flexible, bag-like liner (not shown in FIG. 8). Air evacuation system 10 includes a platform 16 for supporting container 12, and a vacuum assembly 18. In an exemplary embodiment, vacuum assembly 18 is positioned adjacent to container 12 for removing excess air between the liner and container 12. Additionally, vacuum assembly 18 facilitates automated lining of container 12 with the liner in a reduced time as compared to manual lining of container 12 with the liner. Specifically, the liner is transferred from an unseated position, as illustrated in FIG. 1, to a fully seated position, substantially filling container 12, with the use of air evacuation system 10.

Figure 9:
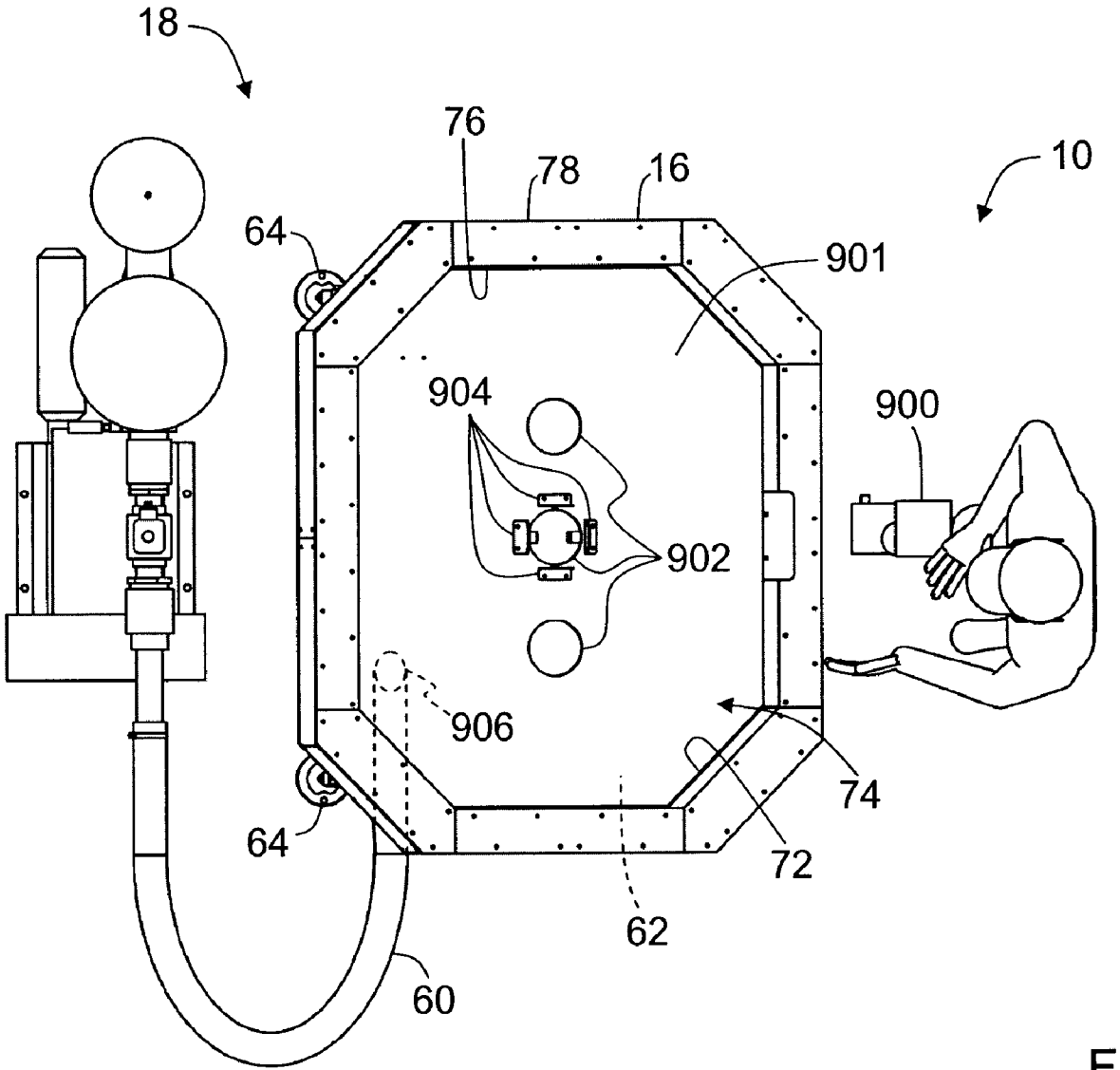
FIG. 9 is a top perspective view of the air evacuation system with the container shown in FIGS. 1-3 removed for clarity.

FIG. 9 is a top perspective view of air evacuation system 10 with container 12 (shown in FIGS. 1-3) removed for clarity. Air evacuation system 10 includes vacuum assembly 18. In an exemplary embodiment, vacuum assembly 18 couples to platform 16 through one or more hoses 60 coupled between blower 50 and platform 16. In the exemplary embodiment, blower 50 operates continuously. In an alternative embodiment, a switch 900 is electrically coupled to blower 50 for activating vacuum assembly 18.

Platform 16 includes base 62 supported by support legs 64. In an exemplary embodiment, base 62 is substantially planar and has a similar shape as container 12 (shown in FIG. 1). Platform 16 includes a floor 901 extending substantially parallel and spaced apart from base 62 such that an air gap is formed between base 62 and floor 901. Floor 901 includes at least one opening 902 therethrough and at least one spacer tab 904 extending therefrom for engaging a bottom wall of the container. The at least one opening 902 may be formed as an aperture through floor 901, a slot through floor 901, a gap between floor 901 and rail 72 or a combination of these or other openings to facilitate drawing air from cavity 22. In the exemplary embodiment, opening 902 is positioned proximate a center of floor 901. Opening 902 may also include a plurality of openings through floor 901.

Spacer tab 904 elevates the bottom wall of the container from floor 901 creating a second air gap between the bottom wall of container 12 and floor 901. Specifically, each spacer tabs 904 engages at least one flap 34 (shown in FIG. 3) of container 12 and displaces the respective flap 34 generally upward toward container cavity 22. As such, spacer tabs 904 facilitate creating an air gap or void between adjacent flaps 34 thus increasing an amount of air evacuated form container cavity 22.

Base 62 and floor 901 cooperate to form is used to form a plenum or an air gap between them. The air gap is facilitated being maintained by ribs 66 raised from an upper surface 68 of base 62. Ribs 66 facilitate maintaining the air gap between base 62 and floor 901.

In the exemplary embodiment, base 62 includes an inlet 906 to vacuum assembly 18. In an alternative embodiment, inlet 906 is positioned in rail 72 between base 62 and floor 901. Collectively, a flow path for air is formed from cavity 22 through flaps 34, opening 902, the air gap between floor 901 and base 62, inlet 906, and hose 60. Side rails 72 define a recess 74 for receiving container 12 therein. When installed, container walls 20 are positioned adjacent platform side rails 72, and in an exemplary embodiment, engage at least a portion of platform side rails 72. As a result, container 12 is positioned or aligned within platform 16, and retained in place for the air evacuation process by vacuum assembly 18. In an exemplary embodiment, each side rail 72 has an interior and an exterior surface 76 and 78, respectively. In an alternative embodiment, side rail 72 includes only a single wall thickness. Hose 60 is coupled to an underside of base 62 or exterior surface 78 such that vacuum assembly 18 is in airflow communication with the air gap between base 62 and floor 901.

Figure 10:
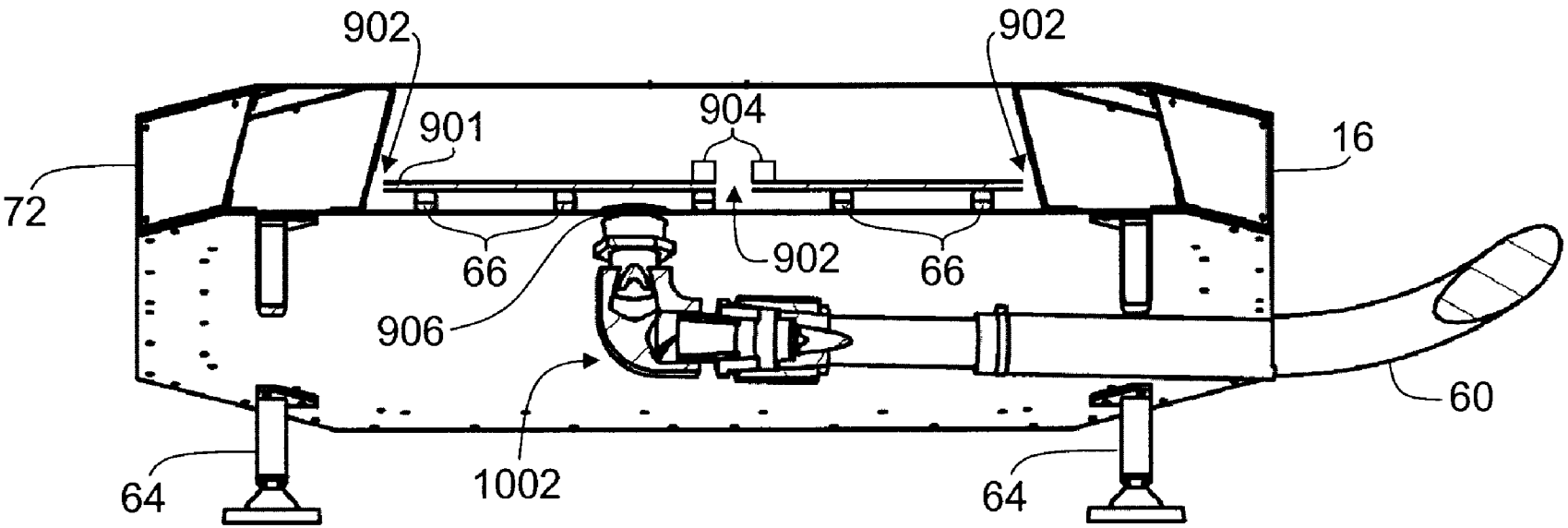
FIG. 10 is a side cross-sectional view of an embodiment of the platform shown in FIG. 9.

FIG. 10 is a side cross-sectional view of an embodiment of platform 16 (shown in FIG. 9). In the exemplary embodiment, platform 16 includes base 62 and floor 901 in substantially parallel and spaced apart relationship with respect to each other. Base 62 includes inlet 906 coupled to an underside of base 62. Inlet 906 is coupled in flow communication with hose 60 through a plurality of fittings and/or couplers 1002. In an alternative embodiment, inlet 906 is coupled to side rail 72 at a position between base 62 and floor 901. Base 62 includes one or more ribs 66 that may be used to stiffen base 62, facilitate maintaining the air gap between base 62 and floor 901, and/or facilitate transferring load from floor 901 to base 62. In an alternative embodiment, a plurality of ribs are interconnected to provide a free-standing member positioned between base 62 and floor 901. In another alternative embodiment, ribs 66 are formed as a part of floor 901.

Floor 901 includes at least one opening 902 therethrough and at least one spacer tab 904 extending therefrom for engaging a bottom wall of the container. The at least one opening 902 may be formed as an aperture through floor 901, a slot through floor 901, a gap between floor 901 and rail 72 or a combination of these or other openings to facilitate drawing air from cavity 22. In the exemplary embodiment, opening 902 is positioned proximate a center of floor 901. Opening 902 may also include a plurality of openings through floor 901.

Spacer tab 904 elevates the bottom wall of the container from floor 901 creating a second air gap between the bottom wall of container 12 and floor 901. Specifically, each spacer tabs 904 engages at least one flap 34 (shown in FIG. 3) of container 12 and displaces the respective flap 34 generally upward toward container cavity 22. As such, spacer tabs 904 facilitate creating an air gap or void between adjacent flaps 34 thus increasing an amount of air evacuated form container cavity 22.

While the invention has been described in terms of various specific embodiments, those skilled in the art will recognize that the invention can be practiced with modification within the spirit and scope of the claims.

What is claimed is:

1. A method of lining a container with a flexible liner using an air evacuation system, the container having a plurality of walls defining a cavity with an open top, each wall having an interior surface and an exterior surface, the air evacuation system having a platform for supporting the container, wherein the platform includes a base and a floor having at least one opening and at least one spacer tab protruding therefrom, and a vacuum assembly coupled to an inlet in at least one of said base and a wall of the platform, said method comprising:

forming the container;

positioning the container on the platform such that a bottom wall of the container is adjacent to the at least one spacer tab protruding from the floor, wherein the bottom of the container is elevated above the floor such that a first gap is defined therebetween;

positioning the liner at least partially within the container cavity, the liner being in an unseated position; and generating a vacuum around at least a portion of the container to draw air from the container cavity through the bottom wall, the first air gap, and the at least one opening such that the liner is positioned adjacent the interior surface of the container in a seated position.

2. A method in accordance with claim 1, wherein operating the vacuum assembly comprises drawing air from the container cavity through the at least one opening, a second air gap between the floor and the base, and the suction member such that the unseated liner is seated against the interior surface of the container cavity.

3. A method in accordance with claim 1, further comprising separating the floor and the base using at least one stiffening rib extending in the second air gap such that the floor is at least partially supported by the base and the second air gap is facilitated being maintained.

4. A method in accordance with claim 1, wherein the at least one opening comprises at least one of an aperture through the floor, a slot through the floor, and a gap between the floor and the platform to facilitate drawing air from the cavity.

5. A method in accordance with claim 1, wherein said generating a vacuum comprises drawing air from the container cavity until substantially all of the air is removed between the interior surface of the container and the liner.

6. An air evacuation system for lining a container with a flexible liner, the container having a plurality of walls defining a cavity with an open top, each wall having an interior surface and an exterior surface, said air evacuation system comprising:

a platform for supporting the container in a formed state, the container including the liner in an unseated position within the cavity wherein said platform comprises a base and a floor extending substantially parallel and spaced apart from said base such that a first air gap is formed between said base and said floor, said floor comprising at least one opening therethrough and at least one spacer tab extending therefrom for engaging a bottom wall of the container, said spacer tab elevating the bottom wall of the container from said floor creating a second air gap between the bottom wall of the container and said floor; and a vacuum assembly coupled to said platform, said vacuum assembly comprising a pump in airflow communication with at least one inlet positioned in said base, said vacuum assembly configured to draw air from the cavity through the bottom wall and the first and second air gaps and the at least one inlet such that the liner is positioned substantially adjacent to the interior surface of the container in a seated position.

7. An air evacuation system in accordance with claim 6, wherein said at least one opening comprises at least one of an aperture through the floor, a slot through the floor, and a gap between the floor and the platform to facilitate drawing air from the cavity.

8. An air evacuation system in accordance with claim 6, wherein said at least one opening comprises an opening proximate a center of said floor.

9. An air evacuation system in accordance with claim 6, wherein said at least one opening comprises a plurality of openings through said floor.

10. An air evacuation system in accordance with claim 6, wherein said at least one spacer tab comprises a plurality of spacer tabs circumscribing said opening.

11. An air evacuation system in accordance with claim 6, further comprising a switch for activating said vacuum assembly.

12. An air evacuation system in accordance with claim 6, wherein the plurality of walls of the container includes a plurality of side walls and a plurality of flaps connected to each of the side walls, wherein the plurality of flaps define a bottom wall of the container, said platform comprises a base and a floor extending substantially parallel and spaced apart from said base and at least one spacer tab extending from said floor for engaging at least one of the flaps of the container, said at least one spacer tab elevating the respective flap such that a gap is formed between the respective flap and an adjacent flap to facilitate increasing an amount of air evacuated from the container cavity by said vacuum assembly.

13. An air evacuation system in accordance with claim 6, wherein at least a portion of the unseated liner is secured to the open end of the container, and wherein said vacuum assembly draws air from between the unseated liner and the interior surface of the container cavity such that the liner is seated against the interior surface of the container cavity.

14. An air evacuation system in accordance with claim 6, wherein said vacuum assembly further comprises at least one stiffening rib extending in the first air gap between said base and said floor such that said floor is at least partially supported by the base and the first air gap is facilitated being maintained.

15. An air evacuation apparatus for positioning a flexible liner within a container, the container having a plurality of walls defining a cavity, each wall having an interior surface and an exterior surface, said air evacuation apparatus comprising:

a platform comprising a base and a floor for supporting the container in a formed state and a plurality of side rails for aligning the container with respect to said platform, the container including the liner in an unseated position within the cavity, wherein said floor extends substantially parallel and spaced apart from said base such that a first air gap is formed between said base and said floor, said floor comprises at least one opening therethrough and at least one spacer tab extending therefrom for engaging a bottom wall of the container, said spacer tab elevating the bottom wall of the container from said floor creating a second air gap between the bottom wall of the container and said floor; and a suction member coupled to at least one of said base and a side wall of said platform, said suction member configured to position the unseated liner in a seated position adjacent the interior surface of the container by drawing air from the container cavity through said bottom wall such that substantially all of the air between the interior surface of the container and the unseated liner is removed.

16. An air evacuation apparatus in accordance with claim 15, wherein said suction member draws air from the container cavity through the at least one opening, the first air gap, and the suction member such that the unseated liner is seated against the interior surface of the container cavity.

17. An air evacuation apparatus in accordance with claim 15, further comprising at least one stiffening rib extending in the first air gap such that said floor is at least partially supported by said base and the first air gap is facilitated being maintained.

18. An air evacuation apparatus in accordance with claim 15, wherein said at least one opening comprises at least one of an aperture through said floor, a slot through said floor, and a gap between the floor and said platform to facilitate drawing air from the cavity.

19. An air evacuation apparatus in accordance with claim 15, wherein said at least one opening comprises at least one opening proximate a center of said floor.

20. An air evacuation apparatus in accordance with claim 15, wherein said at least one spacer tab comprises a plurality of spacer tabs circumscribing said opening.

* * * * *